United States Patent [19]

Rudolph et al.

[11] 3,937,620

[45] Feb. 10, 1976

[54] PROCESS AND APPARATUS FOR GASIFYING COAL

[75] Inventors: Paul Rudolph, Bad Homburg; Hans Kupfer, Frankfurt am Main; Werner Schmidt, Frankfurt am Main-Sud, all of Germany

[73] Assignee: Metallgesellschaft Aktiengesellschaft, Frankfurt am Main, Germany

[22] Filed: Aug. 20, 1974

[21] Appl. No.: 499,095

[30] Foreign Application Priority Data

Sept. 18, 1973 Germany ..... 2346833

[52] U.S. Cl. ..... 48/63; 48/68; 48/202

[51] Int. Cl.[2] ..... C10J 3/16; C10J 3/42

[58] Field of Search ..... 48/63, 73, 77, 99, 202, 48/203, 210, 86 R, 68

[56] References Cited

UNITED STATES PATENTS

| | | | |
|---|---|---|---|
| 1,412,118 | 11/1922 | Johnston | 48/86 R |
| 1,810,738 | 6/1931 | Van Heeden | 48/63 |
| 1,814,787 | 7/1931 | Daae | 48/86 R |
| 1,972,897 | 9/1934 | Odell | 48/63 X |
| 2,808,321 | 10/1957 | Junkers | 48/68 X |

*Primary Examiner*—R. E. Serwin
*Attorney, Agent, or Firm*—Burgess, Dinklage & Sprung

[57] ABSTRACT

Coal is gasified under elevated pressures and temperatures in a reactor having a rotatably mounted grate and supply conduits for oxygen-containing and oxygen-free gasifying agents. The rotary grate contains an internal chamber adjacent to the bearing for the grate and one of the supply conduits is adapted to feed an oxygen-free fluid to this internal chamber. The uppermost portion of the rotary grate contains a substantially closed internal chamber which has a supply conduit for feeding an oxygen-free fluid thereto. A mixing chamber is positioned between the uppermost chamber and the chamber adjacent the bearing for the grate and is provided with passages which lead to the charge to be gasified. The mixing chamber communicates with the uppermost chamber as well as the chamber adjacent the bearing and also has a supply conduit for feeding gasifying agents containing free oxygen thereto.

The process disclosed involves maintaining those portions of the rotary grate having the least resistance to free oxygen in a steam atmosphere.

11 Claims, 2 Drawing Figures

PROCESS AND APPARATUS FOR GASIFYING COAL

BACKGROUND

This invention relates to a process and apparatus for gasifying coal at elevated temperatures and pressures with the aid of oxygen and one or more oxygen-free gasifying agents in a reactor, which has a rotatably mounted grate (rotary grate) for discharging ash and for feeding the gasifying agents.

Gasifying reactors of that kind consist usually of a pressure container, which is suitably surrounded by a water jacket. A pressure lock for feeding the coal to be gasified and an outlet for the raw gas product are provided at the top end of the container. A rotary grate is provided at the lower end of the reactor and cooperates with an ash discharge lock and serves also to distribute the gasifying agents into the fuel bed. Pressure reactors of that kind have been described, e.g. in German Pat. No. 828,759 and U.S. Pat. No. 2,667,409.

Such pressure reactors are operated with a substantially stationary fuel bed. The coal is charged to form a bed of high density and is progressively gasified with formation of ash as it descends toward the rotary grate whereas new material to be gasified is simultaneously strewed onto the fuel bed.

The rotary grates of such reactors must be operated under extremely severe conditions. Above the rotary grate, the gasification zone is disposed, in which a combustion reaction is performed at temperatures above 800°C. The highest temperatures in the coal bed are reached on the level of the rotary grate and the temperatures decrease upwardly toward the distributor. Besides, the rotary grate is constantly in contact with the hot ash, which is discharged by the grate. The gasifying agents consisting of elementary oxygen or air or a mixture of the two, on the one hand, and steam and, if desired, carbon dioxide or nitrogen, on the other hand, flows through the interior of the rotary grate into the gasification zone.

Because of these operating conditions, the material and design of the rotary grate must be selected to meet unusually high requirements. This is particularly applicable to the design of the bearing, in which the grate is rotatably mounted, In known grates, the bearing is exposed to a high-oxygen atmosphere formed by the gasifying agent so that the lubrication of that bearing is rendered very difficult because lubricating oils quickly lose their lubricity under the influence of oxygen at temperatures above 300°C. Another disadvantage of known gasifying reactors resides in that those parts thereof, which are hottest and for this reason are most highly stressed are constantly in contact with oxygen-containing gasifying agents and local extreme temperature rises may result in a combustion of the red-hot steel parts so that the grate is partly destroyed. Such damage may result in even more dangerous situations if it causes molten iron to enter a high-oxygen atmosphere so that the combustion proceeds there and results in a further temperature rise and the entire gas producer may thus be destroyed.

SUMMARY

It is an object of the invention to avoid the disadvantages of the state of the art and to provide a pressure gasification process, which is economical and reliable in operation. In a process of the kind mentioned first hereinbefore, this is accomplished in that those portions of the rotary grate, which have the least resistance to free oxygen are maintained in a steam atmosphere so that the steam acts as a coolant and barrier.

It is important that the bearing portion of the rotary grate is flown through by steam to prevent a decomposition of the lubricant by oxygen. The steam contributes also to the cooling of the bearing.

It will be desirable to cause steam to flow also in contact with the inside surfaces of that portion of the rotary grate, which is subjected to the highest temperatures. This part is usually the tip of the rotary grate, which tip is nearest to the main gasification zone during operation.

According to a further development of the invention the rotary grate is designed so that it contains an internal chamber adjacent to the bearing and a supply conduit for an oxygen-free fluid, generally steam, opens in said chamber. That portion of the rotary grate, which is subjected to the highest temperatures is also provided with a substantially closed, internal chamber and a supply conduit for steam or another oxygen-free fluid opens in the latter chamber.

DESCRIPTION OF THE DRAWING

For a further explanation of the invention, reference is made to the drawing, in which.

DESCRIPTION

Figure 1:
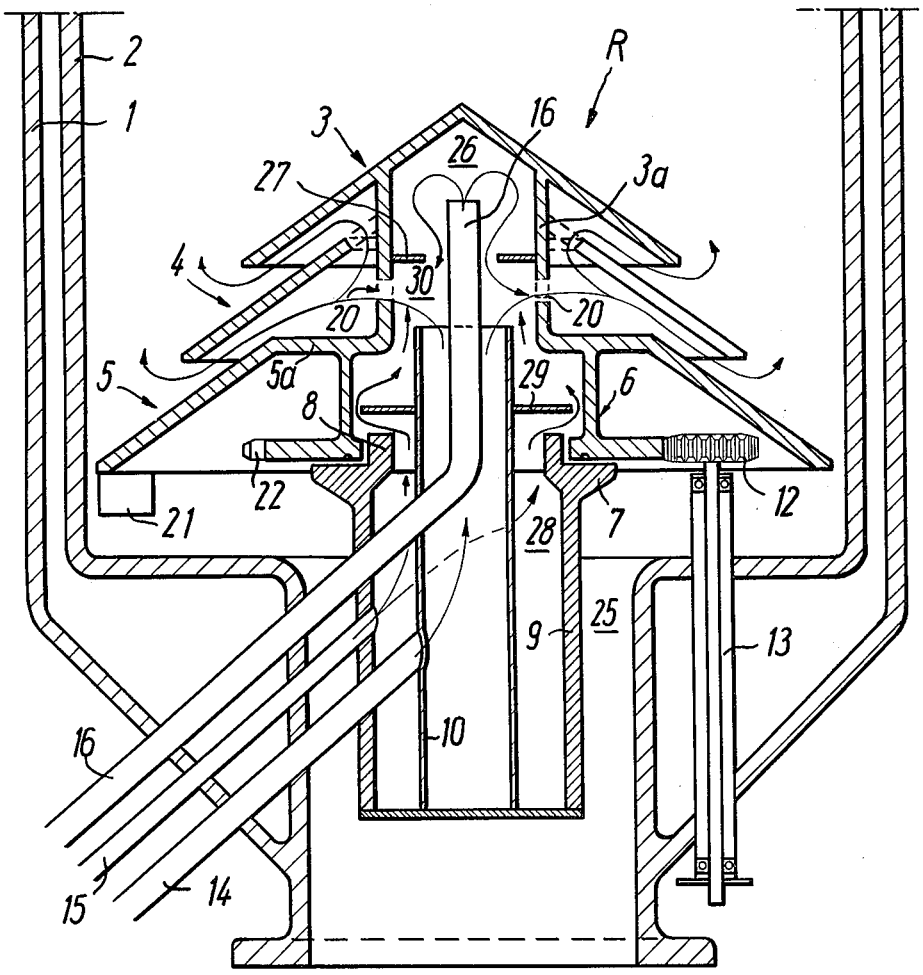
FIG. 1 is a vertical sectional view taken through the lower portion of the pressure reactor, with the rotary grate.

The lower portion of the pressure gasification reactor shown in FIG. 1 comprises a pressure shell 1 and an inner shell 2. Water for cooling the reactor is contained in the space between the two shells, and the high temperatures in the reactor result in a production of steam, which will subsequently be referred to as jacket steam. This jacket steam is used in the reactor itself as a gasifying agent.

The reactor may be, e.g., 3 meters in diameter and comprises a rotatably mounted rotary grate R.

That grate is generally cone-shaped and consists substantially of an upper part 3, an intermediate part 4 and a lower part 5. Parts 3 and 5 are interconnected by a tube 3*a* and an annular disc 5*a*. A bearing disc 6 extends from the annular disc 5*a*. The base of the bearing disc 6 rests on a thrust bearing 7. Any radial forces exerted in the bearing are taken up by the radial bearing 8. The thrust and radial bearings consist of the upper end of a carrying cylinder 9. The grate R is rotationally driven around a vertical axis from a motor, not shown, by a shaft 13, a pinion 12, and a gear 22 belonging to the bearing disc 6. The ash is pushed into the annular chamber 25 by means of one or more scrapers 21, which are similar to plowshares, and is then withdrawn from the reactor.

Three conduits 14, 15, and 16 serve for the supply of gasifying agents, such as steam and oxygen. The gasifying agent flow through these conduits first into the interior of the rotary grate and are partly mixed therein before they enter outwardly into the charge to be gasified. Jacket steam, which is usually at a temperature of about 235°C, and which may be mixed with superheated steam, is supplied through the conduit 16 and first enters an upper chamber 26. The chamber 26 is defined by the upper portion 3, the tube 3*a*, and a deflecting plate 27 in the shape of an annular disc and is substantially closed. An annular outlet opening for the steam from chamber 26 is provided by the annular space between the deflecting plate 27 and the conduit 16. Additional jacket steam is supplied in the conduit 15 to a lower chamber 28, which is formed by the cylinder 9, a tube 10, which is concentric thereto, and a deflecting plate 29. The jacket steam is under a pressure that is slightly higher than the pressure in the reactor but does not exceed the latter by more than about 10 kilograms per square centimeter. Owing to the supply of the jacket steam, an oxygen-free steam atmosphere is formed in the chamber 28, particularly adjacent to the bearing, and part of the steam passes through the bearing clearance directly into the gasification zone. This steam protects the lubricant which is supplied to the bearing by an oil conduit.

Another part of the steam flows from the lower chamber through one or more narrow openings and past the deflecting plate 29 into a mixing chamber 30 positioned between chambers 26 and 28.

A gas, which contains a mixture of steam and free oxygen is supplied into said mixing chamber through the conduit 14 and the tube 10. Water vapor which flows from the upper chamber 26 and past the deflecting plate 27 also enters the chamber 30. The mixture forming in the chamber 30 emerges through openings 20 in the tube 3*a* and is distributed in the charge to be gasified.

The provision of the chamber system and the flow of the different gasifying agents along the paths described above, the upper chamber 26 adjacent to the top part 3 of the grate, and the region of the bearing 6, 7, and 8, are kept free of oxygen, so that a high stability of the grate and a trouble-free lubrication of the bearing are ensured. The upper part 3 is the hottest part of the grate.

Figure 2:
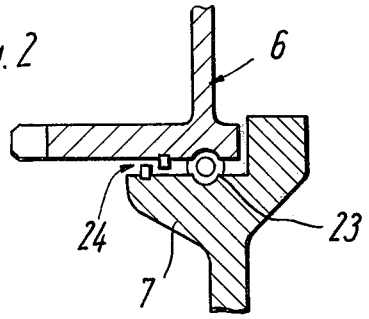
FIG. 2 shows the bearing for the rotary grate in an embodiment, which is modified from that of FIG. 1.

FIG. 2 shows a modified rotary grate, which is mounted on ball bearings 23. Because of these ball bearings the gaps through which the steam flows from the lower chamber 28 into the interior of the reactor are much wider than in the embodiment of FIG. 1. For this reason, FIG. 2 shows also deflecting ribs 24, which minimize the pressure loss of the steam within the bearing.

What is claimed is:

1. Reactor for continuously gasifying coal under elevated pressures and temperatures with, as gasifying agents, oxygen and at least one oxygen-free gasifying agent such as water vapor or carbon dioxide, said reactor comprising a rotary grate rotatably mounted on bearing means, said grate distributing said gasifying agents into said reactor, said rotary grate containing a mixing chamber having openings to release a mixture of said gasifying agents into the coal charge to be gasified, conduit means for supplying a mixture of oxygen and an oxygen-free gasifying agent to said mixing chamber, a lower chamber in said grate below and communicating with said mixing chamber, said lower chamber being adjacent the bearing means for said rotary grate, and further conduit means for supplying an oxygen-free gasifying agent to said lower chamber.

2. Reactor of claim 1 wherein the uppermost portion of the rotary grate contains a substantially closed upper chamber and conduit means are provided for feeding an oxygen-free gasifying agent thereto, said upper chamber communicating with said mixing chamber.

3. Reactor of claim 1 wherein deflecting plates which define passage openings are provided to substantially close said lower chamber.

4. Reactor of claim 1 wherein said lower chamber adjacent the bearing is concentric with said conduit means.

5. Reactor of claim 1 wherein the bearing means has passages for steam.

6. Reactor of claim 1 wherein said bearing is a ball bearing.

7. Reactor of claim 6 wherein the ball bearing is provided with barrier means to restrict the flow of steam.

8. In a process of gasifying coal at elevated temperatures and pressures with oxygen and one or more oxygen-free gasifying agents in a reaction zone having a rotary grate rotatably mounted on bearing means, said grate being adapted for discharging ash and for feeding the gasifying agents, the improvement which comprises maintaining the bearing means for said grate in an oxygen-free, steam atmosphere.

9. Process of claim 8 wherein steam flows through the bearing means of the rotary grate.

10. Process of claim 8 wherein steam flows in contact with the inside of the bearing means for said grate.

11. Process of claim 8 wherein the pressure of the steam atmosphere for the bearing means is higher than the pressure in the reaction zone.

* * * * *